US010359244B2

(12) United States Patent
Cross

(10) Patent No.: US 10,359,244 B2
(45) Date of Patent: Jul. 23, 2019

(54) SEPARATION LIMITER

(71) Applicant: Wes Cross, San Diego, CA (US)

(72) Inventor: Wes Cross, San Diego, CA (US)

( * ) Notice: Subject to any disclaimer, the term of this patent is extended or adjusted under 35 U.S.C. 154(b) by 0 days.

(21) Appl. No.: 16/178,370

(22) Filed: Nov. 1, 2018

(65) Prior Publication Data

US 2019/0137203 A1 May 9, 2019

Related U.S. Application Data

(60) Provisional application No. 62/581,462, filed on Nov. 3, 2017.

(51) Int. Cl.
*F41A 3/66* (2006.01)
*F41A 11/00* (2006.01)

(52) U.S. Cl.
CPC ..... *F41A 3/66* (2013.01); *F41A 11/00* (2013.01)

(58) Field of Classification Search
CPC ..... F41A 23/18; F41G 11/003
USPC ..... 42/90, 106, 75.03
See application file for complete search history.

(56) References Cited

U.S. PATENT DOCUMENTS 3,834,052 A * 9/1974 Steck, III ..... F41G 11/001 42/124
4,837,963 A * 6/1989 Slappey, Jr. ..... B25B 27/02 42/90
5,555,662 A * 9/1996 Teetzel ..... F41A 9/62 356/10
5,930,935 A * 8/1999 Griffin ..... F41C 27/06 42/105
6,872,039 B2 * 3/2005 Baus ..... F16B 21/125 411/347
7,021,187 B1 * 4/2006 Grassi ..... F42B 30/04 89/6.5
7,409,912 B2 * 8/2008 Cerovic ..... F41H 13/0018 102/502
7,937,876 B1 * 5/2011 Graham ..... F41A 11/00 42/75.01
9,151,555 B1 * 10/2015 Huang ..... F16B 15/02
9,389,031 B2 * 7/2016 Gardner ..... F41A 3/66
10,145,638 B1 * 12/2018 Bonderer ..... F41A 11/00
2005/0132628 A1 * 6/2005 Olson ..... F41A 17/74 42/105
2006/0191183 A1 * 8/2006 Griffin ..... F41C 23/16 42/72
2007/0271832 A1 * 11/2007 Griffin ..... F41C 23/16 42/72
2009/0277069 A1 * 11/2009 Delmonico ..... F41C 27/00 42/105
2015/0052793 A1 * 2/2015 Cassady ..... F41A 9/61 42/8
2015/0059221 A1 * 3/2015 Bero ..... F41A 3/66 42/16
2019/0072123 A1 * 3/2019 Adams ..... F16B 19/02

* cited by examiner

*Primary Examiner* — Joshua E Freeman
(74) *Attorney, Agent, or Firm* — Eric Hanscom

(57) ABSTRACT

In broad embodiment, the present embodiment is a separation limiter, which reduces the possible angle of motion of the upper and lower receivers of an AR-15 style firearm. The present embodiment also reduces the risk of pinching of hands and fingers when pivoting an AR15 style firearm about a front take down pin.

18 Claims, 4 Drawing Sheets

SEPARATION LIMITER

CROSS REFERENCE TO RELATED APPLICATIONS

This application claims priority to U.S. Provisional Application No. 62/581,462, entitled "Separation Limiter", filed 3 Nov. 2017.

STATEMENT REGARDING FEDERALLY SPONSORED RESEARCH OR DEVELOPMENT

This invention was not federally sponsored.

BACKGROUND OF THE INVENTION

Field of the Invention

The present invention is in the technical field of firearms. More particularly, the present invention is in the technical field of firearm pins. More particularly still, the present invention is in the field of firearm pins that can have pieces of a firearm or firearm accessories that pivot about the pin, and the present invention limiting the degree with which the firearm or firearm accessories can be pivoted.

Semi-automatic firearms have been known for a long time, the first semi-automatic rifle was introduced in 1885. The M-16 automatic rifle was designed in 1956 and has been used by the military from 1964. A civilian version of the M-16 is known as the AR-15 and is a semi-automatic rifle. The AR-15 has been manufactured and sold to civilians for many years.

In recent years there have been many new laws that apply to the civilian-owned AR-15 firearm. One such law has called for the separation of two halves of a firearm in order to reload a magazine, by means of disassembling the action on a two-part receiver, like that on all AR-15 style firearms. The law requires the rear takedown pin to be removed, the upper receiver lifted upwards and away from the lower receiver using the front takedown pin as the fulcrum, before the magazine may be removed.

It is also a common practice by weapon enthusiasts who use firearms with two-part receivers, like that on an AR-15, to remove the rear takedown pin and pivot the upper receiver about the front takedown pin in order to access the inside of the firearm. The action of using the front takedown pin as the fulcrum, and pivoting the upper receiver does not need to be greater than a few inches. The present invention arrests the motion of the upper receiver while keeping the firing mechanism disassembled, as well as at a height to release a magazine in compliance of a regulated states. The present invention arrests the motion of the upper receiver as well as allows it to come to rest on the present invention, which aids the user in safe handling as well as reloading while the firing mechanism is disassembled and the front take down pin is installed.

The inception of this and other laws has created an increased need for separation of the two halves of a firearm, by means of pivoting about the front takedown pin. This has created a need for an invention to arrest the rotation of the upper receiver to a safe point. The present invention is intended to arrest the motion of the upper receiver, which is pivoted about the front take down pin, by means of securing a body between the upper and lower receiver, and that body is retained in place by the front take down pin, also called a "retaining pin" and or a part commonly known as a "Pin Pal" manufactured by Cross Armory.

The present embodiment's function is to reduce the angle of motion of the upper receiver, while still disassembling the firearms firing mechanism. The present embodiment attaches to a retaining pin such as a Pin Pal, which is a variation of a front take down pin, that the upper receiver pivots about when reloading weapons in regulated states. The present embodiment consists of a hanger, which holds a stopper in place, and that stopper is retained by a nut attached to the hanger.

While the aforementioned embodiment is considered a preferred embodiment, an alternate embodiment could consist of a stopper that clicks permanently in place and does not require a stopper, or a stopper that threads on until the desired position is reached. One alternate embodiment could use differing fasteners to retain the stopper as well as differ the shape of the stopper in order to reduce the angle of arrest caused by the stopper for specific upper receivers. An additional alternate embodiment could include the stopper being suspended on a hanger from the opposite side, and or not requiring a retaining pin such as a "Pin Pal" device.

SUMMARY OF THE EMBODIMENT

The present embodiment is an addition to a front take-down pin assembly, comprising of a hanger, a stopper and a nut. The present embodiment allows for the upper and lower receivers to pivot about the front take down pin it is attached to, in this case a retaining pin such as a Pin Pal, where it arrests the motion of the upper receiver when the rear take down pin is removed. The present embodiment is intended to be placed on the nut of a Pin Pal device or the opposite side. The present embodiment has a hanger that fits the nut of a Pin Pal, a stopper that attaches to that hanger and a nut that retains that stopper to the hanger. The present embodiment can be installed and uninstalled by means of unscrewing a front take down pin like a Pin Pal, to which the hanger of the present embodiment is attached.

BRIEF DESCRIPTION OF THE DRAWINGS

One preferred form of the invention will now be described with reference to the accompanying drawings.

DETAILED DESCRIPTION OF THE EMBODIMENT

Figure 1:
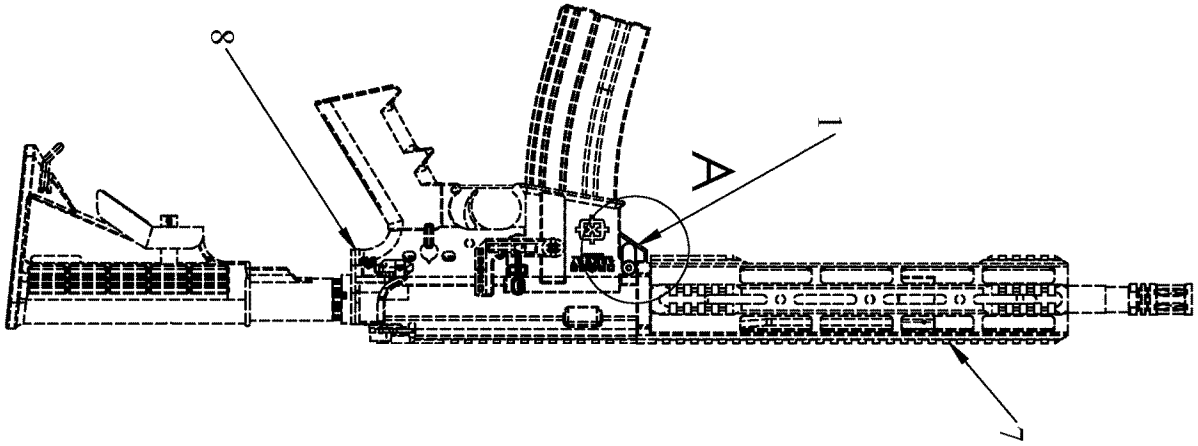
FIG. 1 is a side view of an AR-15 style rifle in the closed position, with the present embodiment installed.

The present embodiment will now be described in detail with reference to the accompanying drawings. In the following description, numerous specific details are set forth in order to provide a thorough understanding of embodiments of the present embodiment. It will be apparent, however, to one skilled in the art, that embodiments may be practiced without some or all of these specific details. In other instances, well known process steps and/or structures have not been described in detail in order to not unnecessarily obscure the present embodiment. The features and advantages of embodiments may be better understood with reference to the drawings and discussions that follow.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Since the basic firearm is of a well-known type, only those parts of the firearm essential to an understanding of the present embodiment will be described in detail. Although the present embodiment will be described with reference to the exemplary embodiments shown in the drawings, it should be understood that the present embodiment can be embodied in many alternate forms or embodiments. In addition, any suitable size, shape or type of elements or materials could be used.

The present embodiment is a upper and lower receiver arresting assembly, comprising of a hanger, stopper and nut. The present embodiment allows for the upper and lower receivers to pivot about a front take down pin like the Pin Pal, and have the angle of motion be arrested by the present embodiment, by means of the stopper held by the hanger.

The present embodiment has a hanger that is retained by a Pin Pal device or similar, and that hanger holds a stopper, which is retained in place by a nut, which is attached by means of threading on the arm of the hanger.

FIG. 1. Referring now to the present embodiment 1 in more detail. In FIG. 1 there is shown a side view of an AR-15 style rifle in the closed position, with the present embodiment 1 installed. There is shown the upper receiver 7 and the lower receiver 8, closed together.

Figure 2:
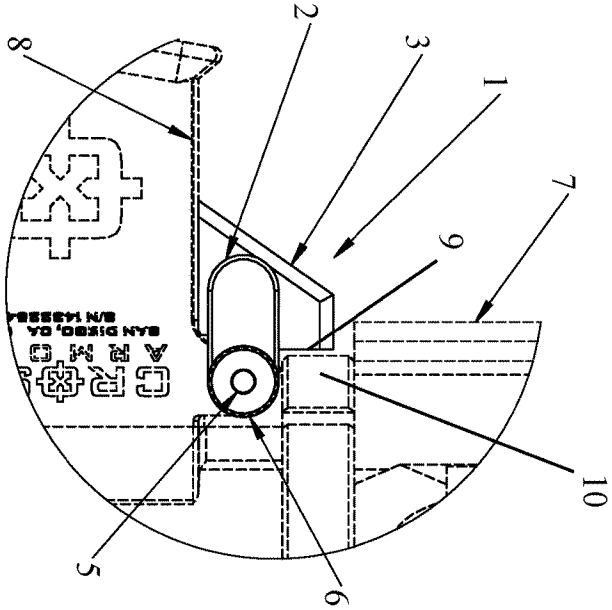
FIG. 2 is a detail view A of an AR-15 style rifle in the closed position with the present embodiment installed.

FIG. 2. Referring now to the present embodiment 1 in more detail. In FIG. 2 there is shown a detail view A of an AR-15 style rifle in the closed position with the present embodiment 1 installed. The present embodiment 1 is attached to a retaining pin such as a Pin Pal Nut 6 and Pin Pal Pin 5. The present embodiment has a hanger 2 that holds the stopper 3 below the upper receiver 7. The stopper 3 naturally rests against the lower receiver 8 and there is a gap between the stopper 3 and the upper receiver 7.

Figure 3:
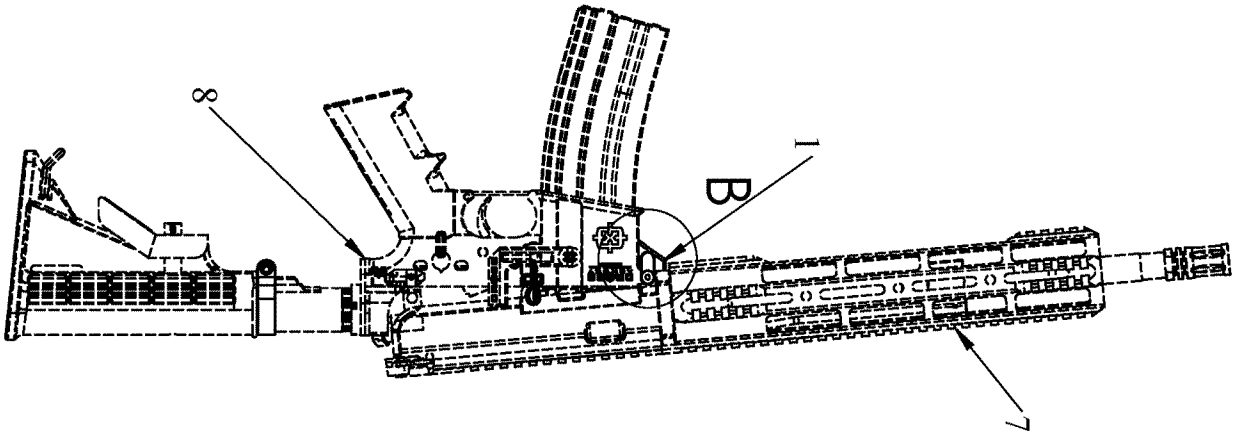
FIG. 3 is a side view of an AR-15 style rifle in the open position, with the present embodiment installed.

FIG. 3. Referring now to the present embodiment 1 in more detail. In FIG. 3, there is shown a side view of an AR-15 style rifle in the open position, with the present embodiment 1 installed. The upper receiver 7 is shown pivoted about the front pivot pin, separating it from the lower receiver 8.

Figure 4:
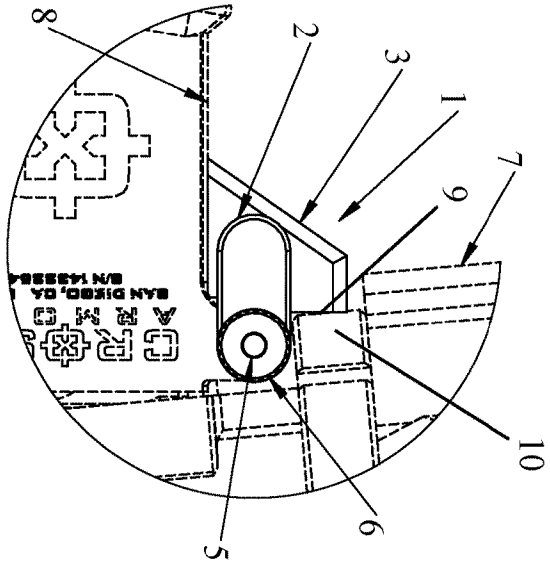
FIG. 4 is a detail view B of an AR-15 style rifle in the open position, with the present embodiment installed.

FIG. 4. Referring now to the present embodiment 1 in more detail. In FIG. 4, there is shown a detail view B of an AR-15 style rifle in the open position, with the present embodiment 1 installed. The present embodiment 1 is attached to a retaining pin such as a Pin Pal Nut 6 and Pin Pal Pin 5. The present embodiment has a hanger 2 that holds the stopper 3 below the upper receiver 7. The stopper 3 naturally rests against the lower receiver 8 and the upper receiver 7 rests on the stopper 3. The stopper 3 creates a mechanical block, that arrests the movement of the upper receiver 7 form rotating farther. As the upper receiver 7 moves in a downward direction, the handguard assembly 10 contacts the stopper edge 9 and stops the movement of the upper receiver.

Figure 5:
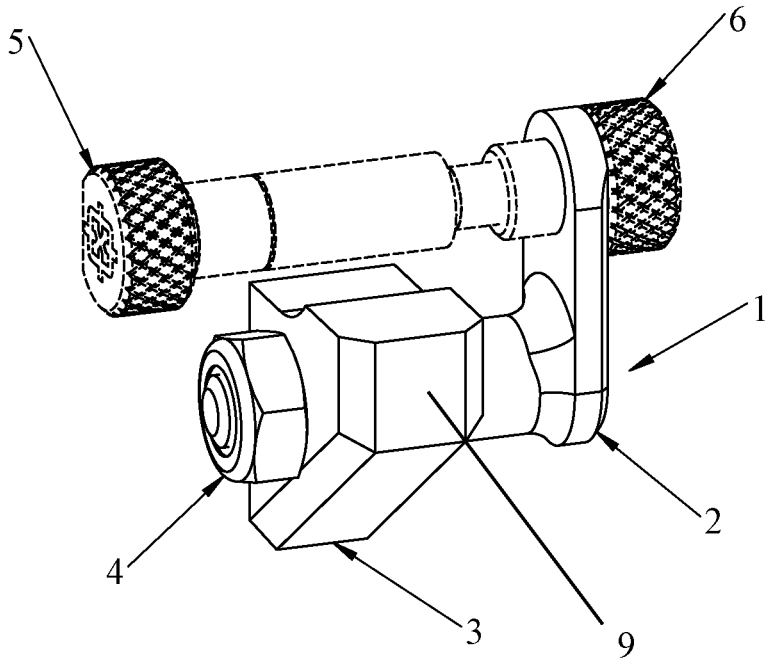
FIG. 5 is an isometric view of the present embodiment, installed on a Pin Pal.

FIG. 5. Referring now to the present embodiment 1 in more detail. In FIG. 5, there is shown a isometric view of the present embodiment 1, installed on a Pin Pal 5,6. The present embodiment 1 is attached to a Pin Pal Nut by means of a hanger 2. The hanger retains a stopper 3 in the center mass of a retaining pin such as a Pin Pal Pin 5, which is centered on a lower receiver 8. The stopper 3 is retained on the hanger 2 by a nut 4.

Figure 6:
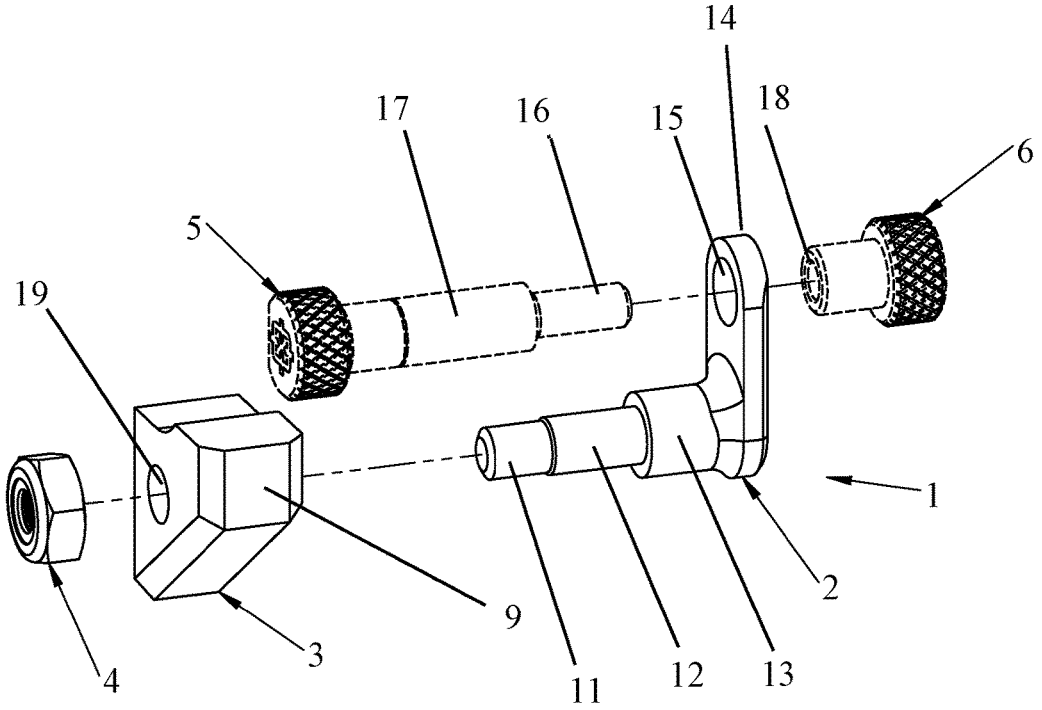
FIG. 6 is an isometric exploded view of the present embodiment, installed on a Pin Pal.

FIG. 6. Referring now to the present embodiment 1 in more detail. In FIG. 6, there is shown an isometric exploded view of the present embodiment 1, installed on a Pin Pal Nut 6 and Pin Pal Pin 5. The present embodiments hanger 2 is slid over the Pin Pal Nut 6. The Pin Pal Nut 6 is then threaded and well attached to the Pin Pal Pin 5 and a AR-15 style weapons lower receiver 8, thus fixing the present embodiment 1 to a AR15 style weapon. The stopper 3 is slid on to the hanger 2. The stopper 3 is retained on the hanger by the nut 4, which is threaded on the end of the hanger 2. The hanger 2 has a hanger threads 11 section, upon which the nut 4 removably mates, a hanger terminal diameter 12 over which the stopper hole 19 slides. Because stopper hole 19 has a smaller diameter than hanger inner diameter 13, the stopper 3 is effectively secured between hanger inner diameter 13 and nut 4. Pin Pal™ pin 5 has a Pin Pal™ body 17 and Pin Pal™ threads 15. Hanger hole 14 has a diameter greater than Pin Pal™ body 17, so Pin Pal™ body 17 slides through hanger hole 15, and Pin Pal™ nut 6 has inner Pin Pal™ threads 18 that removably mate with Pin Pal™ threads 15 to removably secure hanger 14 (and thereby, stopper 3) to the Pin Pal™.

Operation of the Embodiment

Referring now to FIG. 3, and the present embodiment 1, the present embodiments function is to arrest the maximum angle of motion of the upper receiver 7, which pivots about a Pin Pal Pin 5 and Pin Pal Nut 6. The motion of the upper receiver 7 is arrested by the present embodiments stopper 3, which prevents farther motion of the upper receiver 7 from the lower receiver 8. As the upper receiver 7 moves in a downward direction, the stopper edge 9 of the stopper 3 comes into contact with the handguard assembly of the upper receiver 7 and halts any further movement in a downward direction.

Referring now to FIG. 4, the stopper 3 of the present embodiment 1 rests on the lower receiver 8 and is retained in place by means of the hanger 2 which is attached to a Pin Pal Nut 6 and Pin Pal Pin 5 that passes through and is well fastened to the lower receiver 8. When the upper receiver 7 pivots about the Pin Pal Nut 6 and Pin Pal Pin 5, the stopper 3 arrests the upper receiver's motion.

The present embodiment 1 is a upper receiver 7 rotation arresting assembly, comprising of a hanger 2, a stopper 3 and a nut 4 attached to a front take down pin like a Pin Pal Nut and Pin assembly 5,6. The present embodiments 1 assembly is intended to reduce the degree of separation of an AR-15 style firearms upper receiver 7 and a lower receiver 8.

The stopper 3, of the present embodiment 1, creates a resting surface for the AR-15 style upper receivers 7, allowing a AR15 style rifle to rest in a open and unassembled fashion, until such time an individual wishes to pivot the upper receiver 7 back in to a closed position.

Advantages

The advantages of the present embodiment include, without limitation, the arresting of un-wanted rotation about a front take down pin of an upper receiver of an AR15 style weapon. The present embodiment is also advantageous because of the incorporation use of a hanger, that attaches to a front take down pin like the Pin Pal, which secures the present embodiment in place well for multiple repeated uses. Compared to the current method, which is a full swing and opening of an upper receiver of an AR15 style firearm, the present embodiment reduces the motion of the upper receiver, which reduces un needed movement and possible pinching of fingers and/or banging of the upper receiver on a knee or other body part, as well as reducing reload time required in regulated states. The current embodiment also makes the motion of pivoting the two halves of a weapon about the front takedown pin shorter and more convenient, by means of reducing the degrees of angle about which the upper receiver pivots. This reduction of un-needed motion aids in reloading efficiency as well as reduces pinching of hands caused by excess rotation of the upper receiver.

DRAWINGS—REFERENCE NUMERALS

1. Present embodiment
2. Hanger
3. Stopper
4. Nut
5. Retaining Pin/Pin Pal Pin
6. Retaining Pin/Pin Pal Nut
7. Upper Receiver
8. Lower Receiver
9. Stopper edge
10. Handguard assembly
11. Hanger threads
12. Hanger terminal diameter
13. Hanger Inner diameter
14. Hanger vertical member
15. Hanger hole
16. Retaining Pin/Pin Pal™ threads
17. Retaining Pin/Pin Pal™ body
18. Retaining Pin/Pin Pal™ nut threads
19. Stopper hole There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A device for limiting the separation between the upper receiver and the lower receiver of a semi-automatic gun, comprising a stopper, a hanger and a nut, where the nut has a nut body, a nut hole and nut threads, where the nut threads extend from a first pace of the nut body through a second face of the nut body, stopper comprises a stopper body, a stopper edge and stopper hole, where the stopper hole extends from a front stopper face through a back stopper face, where the hanger comprises a hanger vertical member, where the hanger vertical member has a hanger hole, a hanger inner diameter, a hanger terminal diameter, and hanger threads, where the hanger threads mate the nut threads, such that the hanger terminal diameter can be inserted through the stopper, and the nut can be tightened such that the stopper is retained between the nut and the hanger inner diameter, and where the hanger hole is large enough to allow an anti rotational slip fit pin body to be inserted through it, whereby a plurality of anti rotational slip fit pin threads at a terminal end of the anti rotational slip fit pin body mate with a plurality of anti rotational slip fit pin nut threads located on the inside of an anti rotational slip fit pin nut, such that the stopper can be located such that when the stopper edge comes into contact with a handguard assembly of the upper receiver, and where a contact between the stopper edge and the handguard assembly causes the upper receiver to not rotate further in a downward direction.

2. A device for limiting the separation between the upper receiver and the lower receiver of a semi-automatic gun, comprising a stopper, a hanger and a nut, where the stopper is retained on the hanger by the nut, and where the stopper has a stopper edge such that when the stopper edge comes into contact with a handguard assembly of the upper receiver, and where a contact between the stopper edge and the handguard assembly causes the upper receiver to not rotate further in a downward direction, where the hanger is removably attached to the semi-automatic gun, where the stopper is retained on the hanger by the nut, and where the stopper has a stopper edge such that when the stopper edge comes into contact with a handguard assembly of the upper receiver, and where a contact between the stopper edge and the handguard assembly causes the upper receiver to not rotate further in a downward direction, where the nut has a nut body, a nut hole and nut threads, where the nut threads extend from a first pace of the nut body through a second face of the nut body, stopper comprises a stopper body, a stopper edge and stopper hole, where the stopper hole extends from a front stopper face through a back stopper face, where the hanger comprises a hanger vertical member, where the hanger vertical member has a hanger hole, a hanger inner diameter, a hanger terminal diameter, and hanger threads.

3. The device of claim 2, where the hanger threads mate the nut threads, such that the hanger terminal diameter can be inserted through the stopper, and the nut can be tightened such that the stopper is retained between the nut and the hanger inner diameter.

4. The device of claim 3, where the hanger hole diameter is large enough to allow a retaining pin body to be inserted through it, whereby a plurality of retaining pin body threads at a terminal end of the retaining pin body mate with a plurality of retaining pin body nut threads located on the inside of a retaining pin body nut, such that the stopper can be located such that when the stopper edge comes into contact with a handguard assembly of the upper receiver, and where a contact between the stopper edge and the handguard assembly causes the upper receiver to not rotate further in a downward direction.

5. The device of claim 4, where the retaining pin is an anti rotational slip fit pin.

6. The device of claim 4, where the stopper is connected to an intersection between an upper receiver and a lower receiver in a semi-automatic gun.

7. The device of claim 2, where the stopper is connected to an anti rotational slip fit pin, where the upper receiver rotates about an anti rotational slip fit pin.

8. The device of claim 2, where the stopper additionally comprises a stopper edge, where the stopper edge comes into contact with a handguard assembly of the upper receiver, and where a contact between the stopper edge and the handguard assembly causes the upper receiver to not rotate further in a downward direction.

9. The device of claim 8, additionally comprising a hanger, and where the stopper additionally comprises a stopper hole, where the hanger can be inserted into the stopper hole.

10. The device of claim 9, where the hanger comprises a hanger threads, a hanger terminal diameter, a hanger inner diameter, a hanger vertical member, and a hanger hole, where the hanger hole is located at a top of the hanger vertical member, and the hanger threads are at the far end of the hanger furthest away from the hanger member, and the hanger inner diameter is located in conjunction with the hanger vertical member, and the hanger terminal diameter is located in between the hanger inner diameter and the hanger threads.

11. The device of claim 10, additionally comprising a nut, where the nut has threads that mate with threads on the hanger, such that the stopper can be removably secured about the hanger.

12. The device of claim 2, where the hanger has a terminal diameter, which is the diameter closest to its tip, and an inner diameter, which is the diameter further away from its tip, and where the terminal diameter is smaller than the diameter of the stopper hole, and the inner diameter is larger than the diameter of the stopper hole, such that the stopper is secured on one side by the nut and on the other side by the inner diameter.

13. The device of claim 12, where the hanger hole has a hanger hole diameter, and the anti rotational slip fit pin additionally comprises an anti rotational slip fit pin pin and an anti rotational slip fit pin nut, and where the anti rotational slip fit pin pin additionally comprises an anti rotational slip fit pin body and an anti rotational slip fit pin threads, and where the anti rotational slip fit pin nut additionally comprises anti rotational slip fit pin nut threads, and where the anti rotational slip fit pin threads removably mate with the anti rotational slip fit pin nut threads, thereby securing the anti rotational slip fit pin pin to the anti rotational slip fit pin nut.

14. The device of claim 13, where the anti rotational slip fit pin pin body has an anti rotational slip fit pin pin body diameter, and the anti rotational slip fit pin body diameter is less than the hanger hole diameter, such that the anti rotational slip fit pin pin body can be inserted through the hanger hole 15 and the hanger 2 and stopper 3 can be removably secured to the anti rotational slip fit pin.

15. The device of claim 14, where when an upper receiver on a semi-automatic gun is opened, the upper receiver rotates in a downward position about the anti rotational slip fit pin until the handguard assembly comes into contact with the stopper edge, whereupon the rotation of the upper receiver is stopped.

16. The device of claim 2, where the stopper is connected to a take-down pin, where the upper receiver rotates about the take-down pin, where the stopper additionally comprises a stopper edge, where the stopper edge comes into contact with a handguard assembly of the upper receiver, and where a contact between the stopper edge and the handguard assembly causes the upper receiver to not rotate further in a downward direction.

17. The device of claim 16, where when an upper receiver on a semi-automatic gun is opened, the upper receiver rotates in a downward position about the take-down pin until the handguard assembly comes into contact with the stopper edge, whereupon the rotation of the upper receiver is stopped.

18. The device of claim 17, where when an upper receiver on a semi-automatic gun is opened, the upper receiver rotates in a downward position about the anti rotational slip fit pin until the handguard assembly comes into contact with the stopper edge, whereupon the rotation of the upper receiver is stopped.

* * * * *